United States Patent [19]

Rubinstein

[11] Patent Number: 4,704,985

[45] Date of Patent: Nov. 10, 1987

[54] SPRAY GUN MOVER

[75] Inventor: Mordecai Rubinstein, Richon Le Zion, Israel

[73] Assignee: Nordson Corporation, Westlake, Ohio

[21] Appl. No.: 868,934

[22] Filed: May 30, 1986

[51] Int. Cl.[4] ..... B05B 13/06

[52] U.S. Cl. ..... 118/316; 118/318; 118/321; 118/323

[58] Field of Search ..... 118/DIG. 10, DIG. 11, 118/316, 318, 321, 323

[56] References Cited

U.S. PATENT DOCUMENTS

| | | | |
|---|---|---|---|
| 2,170,314 | 8/1939 | Williams | 91/44 |
| 2,344,905 | 3/1944 | Short | 118/DIG. 11 |
| 2,955,568 | 10/1960 | Blenman et al. | 118/323 |
| 3,008,648 | 11/1961 | Brady et al. | 118/323 X |
| 3,022,011 | 2/1962 | Hegyi | 239/97 |
| 3,189,001 | 6/1965 | Thoma et al. | 118/318 |
| 3,402,697 | 9/1968 | Kock | 118/323 X |
| 3,599,871 | 8/1971 | Ruppel | 239/227 |
| 3,812,728 | 5/1974 | Lee et al. | 118/323 X |
| 4,377,127 | 3/1983 | Tinchon | 118/306 |

OTHER PUBLICATIONS

Basic Graphical Kinematics, Kepler, Harold B., copyright 1960, 1973 McGraw-Hill, Inc., pp. 9, 10.

Standard Handbook for Mechanical Engineers, Theodore Baumeister, 7th edition, pp. 8-3, 8-4.

*Primary Examiner*—Shrive P. Beck

*Attorney, Agent, or Firm*—Wood, Herron & Evans

[57] ABSTRACT

A spray gun mover includes a lance extension carried by a movable frame mounted on forward and rearward struts of different lengths. The struts are pivoted to the movable frame at their top ends, and to a stationary frame at their lower ends. A coating apparatus is mounted on the distal end of the lance and is moved along the axis of a rotating drum through a predetermined path, preferably comprising a substantially straight line. A second lance is provided for coating the drum exterior.

4 Claims, 4 Drawing Figures

SPRAY GUN MOVER

This invention relates to spray gun movers and more particularly to a reciprocator or oscillator for moving a coating apparatus with respect to a surface to be coated, so that the surface can be uniformly coated or coated in a desired pattern.

In the manufacture or reconditioning of hollow, cylindrical articles such as drums or barrels, it has been common to spray coat the interior of the articles with a desired coating material in either liquid or powder form. Typically, a gun mover mounts a spraying device for extension into the article, so that it can spray material onto the interior surface to be coated, and for retroaction from the article after coating so another article can be moved into coating position.

One typical known gun mover constitutes a traveling carriage mounted on an I-beam. A spray device is mounted on the carriage and the carriage is driven back and forth by a skotch yoke device or by a motor driven chain and sprocket. In a known chain driven unit, the chain is constantly driven while the carriage is selectively picked up and moved by the chain by appropriate devices.

Such units have several inherent disadvantages. For example, they have many moving parts which tend to wear and require frequent maintenance. Moving parts extend into the durms being sprayed and overspray can build up on the parts in an undesirable fashion, making them difficult to clean and interfering with their movement. Moreover, such units are expensive to manufacture.

Accordingly, it has been an objective of this invention to provide an improved reciprocator or gun mover for coating interior surfaces of cylindrical objects like drums or barrels, and having no movable parts within the object being coated.

A further objective of the invention has been to provide an improved gun mover of simple construction, having a lengthy service life with few moving parts and little wear.

A further objective of the invention has been to provide an improved gun mover capable of coating both interior and exterior surfaces of a cylindrical object such as a drum or barrel.

A further objective of the invention has been to provide an improved gun mover for moving a coating apparatus in a predetermined path with respect to an object to be sprayed, wherein the path is preferably substantially a straight line, but may be varied to follow other predetermined contoured paths.

To these ends, an improved gun mover according to a preferred embodiment of the invention includes a lance extension having a coating apparatus mounted on a distal end for insertion into a rotating drum or barrel along the axis of rotation. The lance extension is mounted on a movable lance frame by means of forward and rearward strut sets pivoted in pillow blocks at lower ends to a stationary support frame and at upper ends to the movable lance frame. An air cylinder operably disposed between the movable lance frame and the stationary frame operates in conjunction with a hydraulic check or damper to reciprocate the distal end of the lance extension into and out of a drum or barrel.

The rear struts are shorter than the forward struts and the point of the pivot connection of the rear struts to the lance frame moves through an arc of lesser radius than the arc circumscribed by the point of the pivot connection of the forward struts to the lance frame. Thus, as the lance extension is extended into a drum or barrel, its rearward end tends to pivot about its distal end, which moves transversely in essentially a straight line. Of course, the motion of the distal end can be varied by means of adjusting the length of the struts and the disposition of the pivots.

A second lance extension, parallel to and spaced from, the first lance extension is also preferably secured to the lance frame. The second extension supports a second coating apparatus for movement in an appropriate path to coat the exterior surface of a rotating drum or barrel at the same time as the ineterior is being sprayed.

In a coating apparatus according to a preferred embodiment of the invention, drums are transported to a coating position where they are disposed for rotation about an axis which is preferably coaxial with the axis of the drum. The lance apparatus is actuated to extend the first coating apparatus into the rotating drum along its axis where the coating apparatus sprays the interior surface. The second coating apparatus is moved along and parallel to the rotating outer surface and is operable to spray it if desired.

There are thus no moving parts within the drum or barrel, nor near the spray or overspray area. The only significant moving parts are the pivots which comprise easily replaceable and inexpensive pillow blocks disposed outside the actual coating station and away from any spray pattern or overspray area.

These and other objectives and advantages will become readily apparent from the following detailed description of a preferred embodiment of the invention and from the drawings in which.

Figure 1:
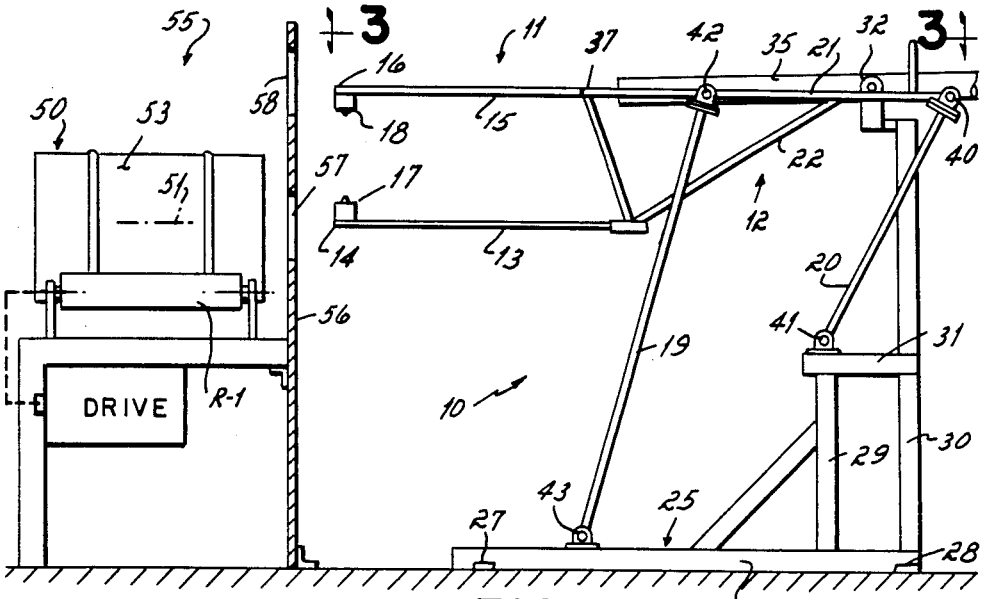
FIG. 1 is a side elevational view of a preferred embodiment of the invention in a retracted position and also depicting a drum to be coated.

Turning now to the drawings, there is shown in FIG. 1 a spray gun mover 10, according to a preferred embodiment of the invention. Gun mover 10 can be either a reciprocator or an oscillator as desired.

Gun mover 10 includes a lance means 11 comprising a movable frame 12, a first lance extension 13 having a distal end 14 thereon, and a second lance extension 15 having a distal end 16 thereon. Mounted to the first lance extension a distal end 14 is first coating apparatus, such as a liquid or powder spray gun 17, shown diagrammatically in the figures. Mounted on the distal end 16 of the second lance extension 15 is a second coating apparatus including a powder or liquid spray gun 18. Lance means 11 further comprises a movable frame 12 which includes frame member 21, 22, a pair or set of forward struts 19 and a pair or set of rearward struts 20. Only one of each of the forward and rearward struts is shown in FIG. 1 and it will be appreciated that a single forward and a single rearward strut could be utilized.

The gun mover 10 further includes a stationary frame 25. Stationary frame 25 includes floor mounted channels 26, and cross tie channels 27 and 28. Stationary frame 25 further includes vertical frame members 29 and 30, extending upwardly, and a horizontal frame member 31 as shown in FIG. 1. Secured to the upper end of the vertical frame member 30 is a trunion mount 32 to which is pivoted an air cylinder 35.

Figure 3:
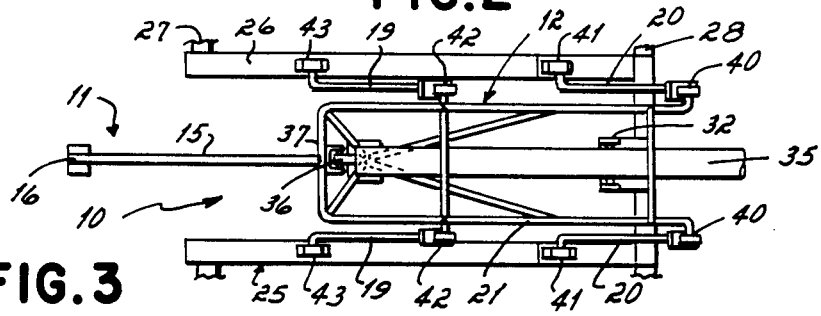
FIG. 3 is a plan view of the embodiment of FIG. 1, taken along lines 3—3 of FIG. 1.

Air cylinder 35 has an extensible piston 36 (FIG. 3) which may be secured to a frame member 37 of the movable frame 12 by any appropriate means. It will be appreciated that the air cylinder 35 is pivotally mounted to the trunion mount 32 intermediate the ends of the air cylinder. Also, it is preferable to use a hydraulic check or damper (not shown) of any suitable type to enhance the smoothness of the motion generated by the air cylinder 35, and to reduce acceleration, deceleration or speed variations in such movement.

Movable frame 12 is secured to the stationary frame 25 by means of pivots at each end of the respective forward and rearward struts 19, 20. In particular, a rearward strut 20 is pivoted at a first pivot 40 to the movable frame 12 and particularly to a frame member 21 thereof. The rearward strut 20 is pivoted at a lower end to a second pivot point 41 mounted on the horizontal frame member 31 of the stationary frame 25. The forward strut 19 is pivoted at its upper end to a third pivot 42, which is secured to the movable frame member 21, and at its lower end to a fourth pivot 43 which is secured to the stationary frame 25 and specifically on the frame member 26 thereof.

It will be appreciated that the first through the fourth pivots, 40, 41, 42 and 43, are defined by ordinary pillow blocks. Such pillow blocks are secured to the upper ends of the respective struts 19, 20 by any suitable means, such as by welding thereon to plates secured to the ends of the struts. The pillow blocks 41, 43 are secured to the stationary frame, while the lower ends of the respective struts 19, 20 are secured to a shaft or rod rotationally mounted in the pillow blocks 41, 43. It should be appreciated that appropriate brace members such as, for example, brace or frame member 22 can be provided in the movable frame 12, or connected to the struts 19 and 20 for the purpose of strengthening or rigidifying the movable frame 12, as may be desired. For example, braces can be used between struts 19 or between struts 20 for rigidity.

The extension of the piston 36 serves to move the movable frame 12 with respect to the stationary frame 25 through a stroke of preferably about 2 feet to about 4 feet to facilitate coating of barrels having a similar length. This movement causes the struts to move through predetermined arcs with respect to their respective pivots 41, 43, thereby extending the lances 13 and 15, as will be described.

It will be appreciated that the cylinder 35 and piston 36 are disposed perpendicularly to the struts 19, 20 only at one particular moment during the movement of the movable frame 12. Nevertheless, and for purposes of description and reference, it will be appreciated that the cylinder 35 and piston 36 are disposed in a position generally perpendicular to the struts 19, 20 and that the angular disposition of the struts to the cylinder generally changes as the piston 36 is extended and the movable frame 12 is moved from its retracted position as shown in FIG. 1 to the extended position as shown in FIG. 2.

A coating facility, according to the invention, includes means such as a pair of rollers R-1 and R-2 for mounting a drum 50 for rotation about an axis 51 at a coating station 55. Axis of rotation 51 is also preferably the axis of the drum 50. It will be appreciated that the wall of drum 50 has interior surface 52 and an exterior cylindrical surface 53. The drum is preferably disposed with its longitudinal axis in a horizontal position, and the entire drum wall is rotated in a cylindrical path having a portion tangent to a horizontal coating plane P as noted in FIGS. 1 and 4 for receiving coating material sprayed onto one or both surfaces 52, 53. The coating station 55 is thus preferably defined by the rollers R-1, R-2 supporting the drum 50 for rotation and a wall 56 having apertures 57 and 58 therein. Aperture 57 is disposed so as to be coincidental and preferably coaxial with the predetermined axis 51 of rotation of the drum 50. The aperture 58 is disposed in a vertical position which is in the embodiment of FIG. 1 above the exterior surface 53 of the rotating drum. Lances 13 and 15 are mounted for extension of their respective distal ends 14, 16 through the respective apertures 57, 58. Accordingly, wall 56 effectively separates the gun mover 10 from the coating station 55, except at such time as the mover is actuated to extend the lances 13 and 15 through the apertures 57, 58 into a position where the spray guns 17, 18 can be operated for coating the drum 50.

Figure 2:
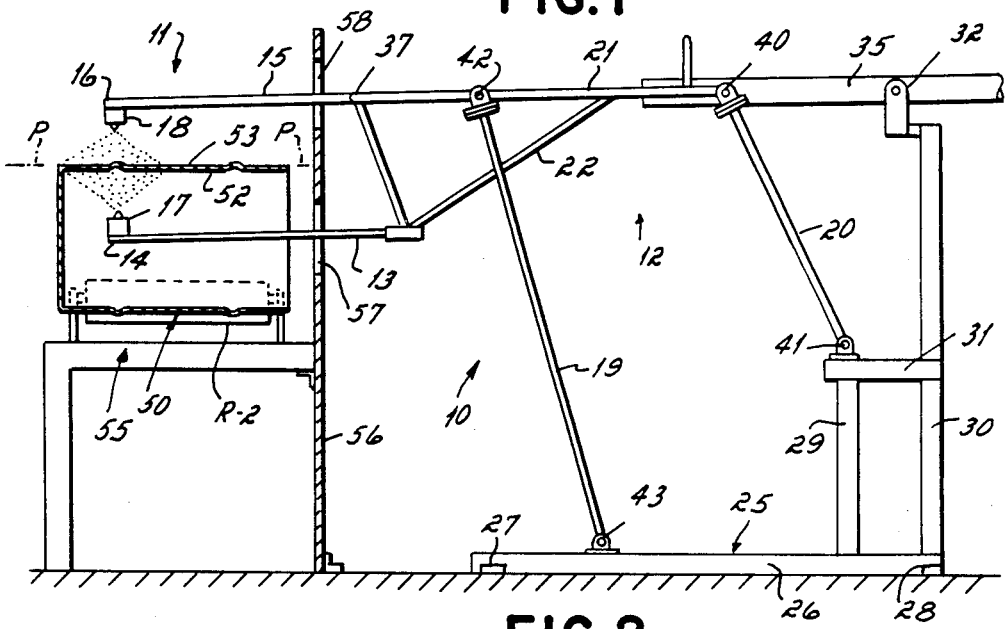
FIG. 2 is a side elevational view of a preferred embodiment of the invention in an extended position, showing a drum in cross-section.

Turning momentarily to FIG. 2, it will be appreciated that the air cylinder 35 has been actuated to as to extend the piston 36 and thereby move the movable frame 12. The lance extension 13 and 15 have moved through the apertures 57, 58 and along a stroke path for the coating of the drum 50. In this regard, it will be appreciated that the most effective coating of a surface is typically conducted by spacing the coating apparatus at a uniform, constant distance from the surface to be coated. Accordingly, it is highly desirable that the coating apparatus 17 and 18 are moved transversely across the respective interior and exterior surfaces of the drum in a predetermined pathway which is at a constant distance from the drum surfaces and comprised of a length of about 2 feet to about 4 feet depending on the similar length of drums to be coated. Accordingly, it is highly desirable that the distal ends 14 and 16 of the lances 13 and 15 remain at a substantially constant distance from the drum surface residing in coating plane P throughout the preferable 2 foot to 4 foot stroke of the lance extension from one end of the drum to the other and while the spray guns are operative for spraying.

Figure 4:
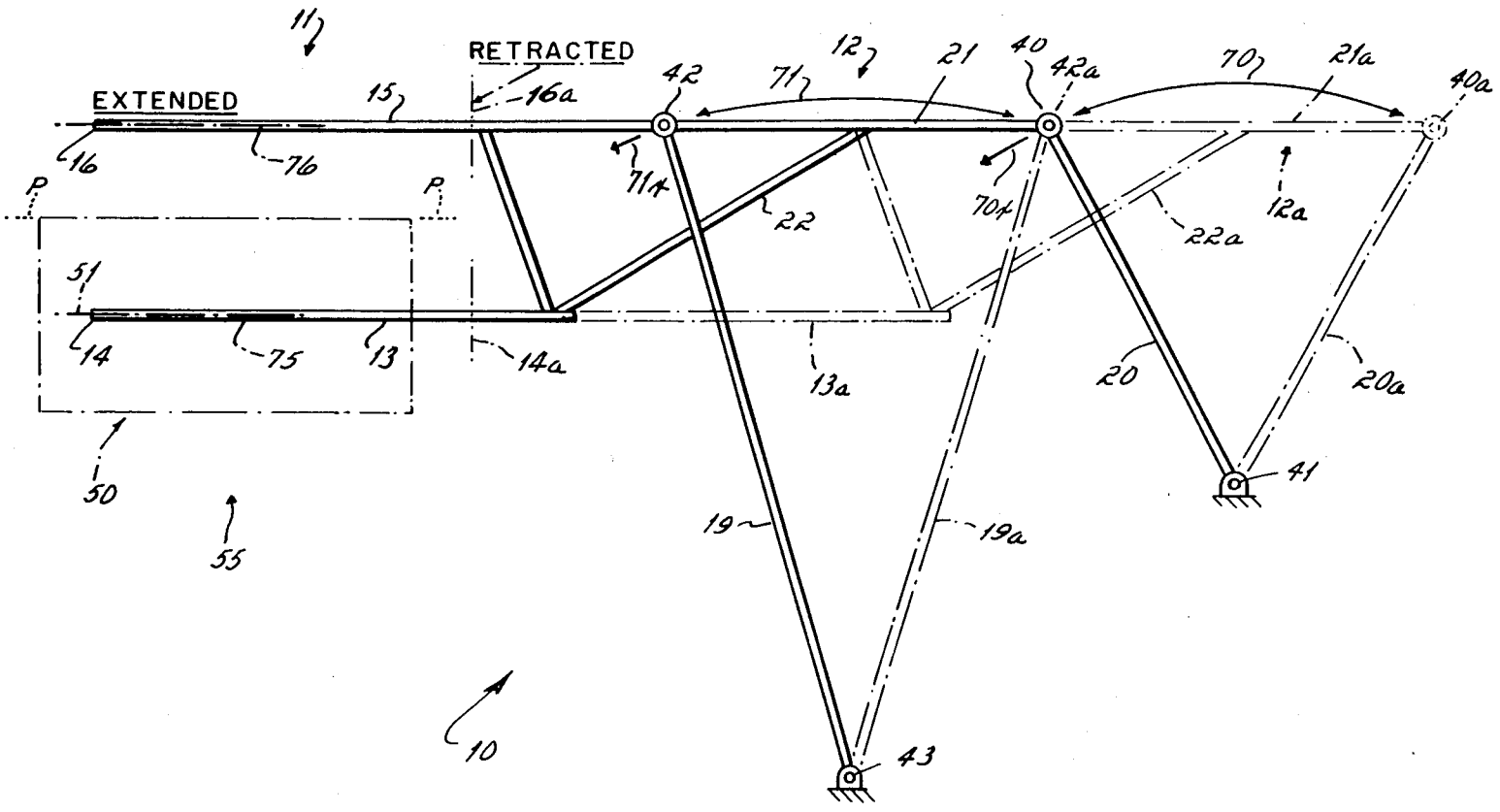
FIG. 4 is a diagrammatic elevational view of the struts, pivots and lance extension motion for the purpose of description of the invention.

Turning now to FIG. 4, the motion of the lance means is diagrammatically depicted for the purposes of description of operation of the preferred embodiment of the invention as shown in FIG. 1. In FIG. 4, two positions of the gun mover are illustrated. The solid line position is shown with the gun mover in an extended condition, while the dotted or phantom line position shows the respective elements of the gun mover in a retracted position, such as that of FIG. 1. In FIG. 4, the reference numerals have been utilized on the elements of the gun mover shown in its extended position. The same reference numerals followed by the suffix "a" have been utilized to indicate similar parts in a retracted position.

Looking now at FIG. 4, it will be appreciated that as the frame 12 is extended, the pivot point 40 moves through a first arc 70, while the pivot point 42 moves through a second arc 71. Also, it will be recollected that the pivot points 41, 43, are secured to the stationary frame 25. Accordingly, the arc 70 has a radius which is essentially equal to the length of the rear strut 20. The arc 71 has a radius which is essentially equal to the length of the forward strut 19. In this regard, it will be appreciated that the forward strut is longer than the rearward strut and that the radius of the arc 71 is greater than the radius of the arc 70. Also, it should be noted that arc 70 has an extension 70X and arc 71 has an extension 71X. Arc 71 and arc extension 71X have a vertical component through their sector which is much less than the vertical component of arc 70 and arc extension 70X through their sector.

Accordingly, it will be appreciated that vertical movement of pivot 40 moves through a predetermined vertical distance, as frame 12 is extended, which is less than the vertical distance covered by pivot 42 for the same forward movement. This relationship applies whether the pivots 40, 42 are moving upwardly through their arcs, as upon initial extension, or downwardly through their arcs, as during final extension. In either case, the greater relative vertical motion of pivot 40 with respect to pivot 42 causes a rotation of the rear end of the movable frame 12 (rear end of member 21) about the extreme forward ends of the frame 12 represented by distal ends 14, 16. At the same time, the distal ends 14, 16 of the lance extensions 13, 15 are moved forwardly. Their motions are in a substantially horizontal straight line as a result of the forward extension of the lances and the apparent motion of the rearward end of the frame member 21, for example, about the distal ends, as appreciated from FIG. 4 and the above discussion.

It will be appreciated then that the pivots 40, 42 and rear portion of frame 12 could, at any time in the forward motion of the frame be higher, or lower than the distal end 16 of lance 15, for example, without a similar vertical movement of the distal end which is projected in a horizontal, substantially straight line direction. Moreover, the substantially straight line 75 is essentially along the axis of the drum and the axis of the drum's rotation, and is substantially parallel to the coating plane P, thus insuring a substantially constant distance between the interior drum surface and the coating apparatus 17. Of course, the substantially straight line of path of movement could be disposed parallel to but spaced from the axis of rotation to maintain a constant but different distance between coating apparatus 17 and the interior surface of the drum. Moreover, a similar constant relationship is also maintained between coating apparatus 127 and the exterior surface of the drum.

The straight line motion then is quite different from the motion which would be generated by the apparatus if the lengths of the struts 19 and 20 were the same. For example, in such an apparatus the frame member 21 and distal end 14 could be extended but both would move vertically with the lance extension 13 simply remaining parallel to a horizontal reference. Distal ends 14 and 16 would be moved through an arc, or a line at an angle to the axis of drum rotation, rather than through a substantially straight line parallel to the axis of rotation. Such motion would be highly undesirable in a gun mover for coating a barrel interior since the distal end 14, as it moved through the length of the barrel would vary its distance from the barrel surfaces in a vertical direction and thus would tend to generate a highly uneven coating on the interior surface of the barrel. Accordingly, it is highly desirable to move the distal end 14 along a predetermined path which is preferably substantially a straight line such as that indicated by the line 75 in FIG. 4.

It will also be appreciated in FIG. 4 that the motion of the second lance extension 15 is also essentially in a straight line 76 parallel to the drum's exterior surface, so that the spraying apparatus 18 moves across the exterior surface 53 of the rotating barrel at a predetermined constant distance therefrom.

It should also be appreciated that any particular spary gun or coating apparatus can be disposed on the lances 13 and 15. This includes both powder and liquid spraying or coating apparatus. Necessary tubing and other connections can be extended along the movable frame members for the spray coating apparatus or the various feed tubes for the coating apparatus can be actually disposed within the lance extensions 13 and 15 themselves for a neater and easier to maintain apparatus. Nevertheless, it will be appreciated that the gun mover has very few moving parts and no moving parts within the coating station 55, except of course for the lance extensions themselves which move through the apertures 57 and 58 into position at the coating station. There are thus no moving parts to be gummed up by spray or overspray of coating material.

Since the gun mover 10 utilizes very few moving parts and since that movement is concentrated at the pivots 40–43, wear generally only occurs at the pivots and particularly the pillow blocks used therefor. Such pillow blocks are very inexpensive and can be easily and readily replaced, thereby substantially reducing any down time for maintenance and maintenance expense over those prior known units utilizing chain driver, skotch yokes, etc., or other moving parts within the coating station.

Of course, it will be appreciated that there can be many modifications to the invention for other desirable purposes. For example, it may be proposed to move the distal ends of the lance extensions in other than a straight line path parallel to the axis of rotation in order to accommodate desired spraying of contoured surfaces, for example, or surfaces moving in paths of varied shapes. This may be accomplished by varying the disposition of the pivots 40–43 with respect to each other, by varying the lengths of the forward and rearward struts 19 and 20, or by varying the acceleration, deceleration or speed of extension or retraction.

Also, while the disclosure herein has been with reference to a generally horizontal extension of the gun mover, it will also be appreciated that the invention contemplates the mounting of similar apparatus on a mounting wall which is vertically disposed, or on a ceiling, for example, to accommodate a particular coating function. Accordingly, the references in the above disclosure to vertical and horizontal dispositions are not by way of limitation, but are only by way of explanation of a preferred floormounted embodiment of the invention, and such references could be changed appropriately where it was desirable to mount the apparatus on a wall or on a ceiling, or on any other surface at a varied disposition other than horizontal floor.

These and other alternatives and modifications will become readily apparent to those of ordinary skill in the art without departing from the scope of this invention and application intends only to be bound by the claims appended hereto.

I claim:

1. Apparatus for moving a coating apparatus in a predetermined substantially straight line path extending into the interior of a rotating cylindrical workpiece and at selected, prdetermined distances therefrom for the operative range of movement of said coating apparatus within said workpiece, said apparatus consisting of:

a coating apparatus;

a lance having a distal end supporting said coating apparatus;

a first, stationary frame;

a second, movable frame, said lance being mounted thereon;

said first and second frames being pivoted together;

two rear struts, two first pivots, each pivoting one end of a rear strut to said first frame;

two second pivots, each pivoting another end of a rear strut to a rear end of said second movable frame, two forward struts;

two third pivots, each pivoting one end of a forward strut to said first frame;

two fourth pivots, each pivoting another end of a forward strut to said second movable frame, between the distal end of said lance and the rear end of said second movable frame;

said forward struts constituting straight links;

said rear struts constituting straight links shorter than said forward struts;

means for moving said movable frame and said lance with the distal end of said lance moving in substantially a straight line from a first position exterior of a workpiece to a second extended position within the interior of a workpiece at a far end thereof with respect to said first position; and the disposition of said pivots being selected such that motion of said movable frame relative to said stationary frame causes the distal end of said lance, and any coating apparatus thereon, to move in as predetermined substantially straight line pathway.

2. Apparatus for moving a coating apparatus in a predetermined, substantially straight line path from an exterior position to a position within the interior of a rotating cylindrical object for coating an interior surface of that object, and including:

a movable lance means having a distal end for mounting a coating apparatus for operative movement thereof in said substantially straight line path;

at least one straight rear strut supporting said lance means, said straight rear strut being pivoted to said lance means at a first pivot and to a stationary support at a second pivot;

at least one straight forward strut supporting said lance means, said straight forward strut being pivoted to said lance means at a third pivot and to a stationary support at a fourth pivot;

said second and fourth pivots being stationary;

said first and third pivots moving through first and second arcs of varying radius during motion of said lance means to generate movement of said distal end of said lance means in a substantially straight line to maintain motion of said coating apparatus in said straight line path, and wherein the length of said rear strut and the radius of said first arc are shorter than the respective lengths of said forward strut and of the raduis of said second arc.

3. Apparatus as in claim 2, wherein said lance means has a rearward end opposite said distal end, said rearward end moving in an arc while said distal end moves in said substantially straight line path.

4. Apparatus for coating hollow drum workpieces rotating about a predetermined axis of roation coaxial with the elongated axis of the drum, said apparatus including an extensible coating sprayer member movable in a substantially straight line path at a common predetermined distance from a rotably interior cylindrical surface of a drum said apparatus comprising:

a drum coating station;

means at said drum coating station for rotating a drum about said axis of rotation coaxial with said drum axis;

a movable lance means having a distal end extensible into and retractable from an interior of said drum in a substantially straight line along said drum axis;

said extensible coating sprayer mounted on said distal end;

a first stationary frame;

a second, movable frame, said lance being mounted thereon;

said first and second frames being pivoted together;

two rear struts, two first pivots, each pivoting one end of a rear strut to said first frame;

two second pivots, each pivoting another end of a rear strut to a rear end of said second movable frame, two forward struts;

two third pivots pivoting one end of a fourth strut to said first frame;

two fourth pivots, each pivoting another end of a fourth strut to said second movable frame, between the distal end of said lance and the rear end of said second movable frame;

said forward struts constituting straight links;

said rear struts constituting straight links shorter than said forward struts;

means for moving said movable frame and said lance, with the distal end of said lance moving in substantially a straight line from a first position exterior of a workpiece to a second extended position within the interior of a workpiece at a far end thereof with respect to said first position; and the disposition of said pivots being selected such that motion of said movable frame relative to said stationary frame causes the distal end of said lance, and any coating apparatus thereon, to move in a predetermined substantially straight line.

* * * * *